US006273531B1

(12) United States Patent
Scheffer

(10) Patent No.: US 6,273,531 B1
(45) Date of Patent: Aug. 14, 2001

(54) REVOLVING STORAGE HUTCH

(75) Inventor: Robert Allen Scheffer, Lynchburg, VA (US)

(73) Assignee: Thomasville Furniture Industries, Inc., Thomasville, NC (US)

( * ) Notice: Subject to any disclaimer, the term of this patent is extended or adjusted under 35 U.S.C. 154(b) by 0 days.

(21) Appl. No.: 09/464,011

(22) Filed: Dec. 15, 1999

(51) Int. Cl.[7] ..... A47B 17/00
(52) U.S. Cl. ..... 312/196; 312/305; 312/249.2
(58) Field of Search ..... 314/194, 195, 314/196, 197, 107, 108, 305, 249.2, 125, 135, 202, 9.4, 9.45; D6/422, 438, 509

(56) References Cited

U.S. PATENT DOCUMENTS

| | | | | |
|---|---|---|---|---|
| D. 296,172 | | 6/1988 | Worrell et al. | D6/509 |
| D. 330,124 | | 10/1992 | Short | D6/422 |
| D. 389,335 | | 1/1998 | Tilley | D6/422 |
| 3,862,785 | * | 1/1975 | Scheerhorn et al. | 312/196 X |
| 4,431,238 | | 2/1984 | Evans | 312/184 |
| 4,555,150 | | 11/1985 | Turnbull . | |
| 5,169,220 | | 12/1992 | Herr et al. | 312/305 |
| 5,277,488 | | 1/1994 | Cleary et al. | 312/408 |
| 5,487,599 | | 1/1996 | Weisburn et al. | 312/9.46 |
| 5,494,347 | * | 2/1996 | Poortvliet et al. | 312/249.2 X |
| 5,547,273 | | 8/1996 | Hudnall | 312/305 |
| 5,651,595 | | 7/1997 | Willis | 312/249.2 |
| 5,662,317 | | 9/1997 | Beakes et al. | 269/58 |
| 5,676,360 | | 10/1997 | Boucher et al. | 269/74 |

FOREIGN PATENT DOCUMENTS

| | | | | |
|---|---|---|---|---|
| 1278824 | * | 6/1972 | (GB) | 312/202 |

OTHER PUBLICATIONS

Sketch of a revolving cube hutch, sketched by the inventor from memory of one seen at a show in Chicago in Jan. 1999, origin unknown, believed to be prior art.

* cited by examiner

*Primary Examiner*—Peter M. Cuomo
*Assistant Examiner*—James O. Hansen
(74) *Attorney, Agent, or Firm*—Rhodes & Mason, PLL

(57) ABSTRACT

A hutch for a desk. The hutch has a top defining a rear edge and at least one side extending forwardly from the rear edge. At least one rotatable support extends downwardly from the top beneath the at least one side that extends forwardly from the rear edge.

3 Claims, 8 Drawing Sheets

REVOLVING STORAGE HUTCH

FIELD OF THE INVENTION

The present invention generally relates to furniture, and relates particularly to a furniture hutch that has an integral, rotatable storage cabinet.

BACKGROUND OF THE INVENTION

Storage cabinets for various office supplies are known in the art. For example, U.S. Pat. No. 5,651,595 to Willis and U.S. Pat. No. 5,487,599 to Weisburn et al. disclose rotatable storage cabinets designed for storing recordable media such as compact discs, floppy disks, cassettes, and the like. The rotating nature of these cabinets is preferred to facilitate accessibility and convenience. Heretofore, many of such storage cabinets are relatively lightweight and mobile to allow the operator to place the cabinet in a convenient and amenable location on a desktop.

A variety of desks exist that are specifically amenable as a workstation for computer use. For example, U.S. Pat. No. 4,555,150 to Turnbull discloses a substantially L-shaped workstation designed to accommodate the demand for increased workable area when a computer, or other tool, dominates the desktop. Desks, as known in the art, occasionally are designed with storage elements for office supplies. For example, a desk drawer may include an organizing tray for compartmentalizing office supplies. Also, desks may include a hutch designed with appropriately spaced cubicles for organizing paper supplies or work product.

The prior art lacks, however, a combination desk and hutch with rotatable storage cabinet capabilities. There is a need in the art for a desk and hutch that provides sufficient desktop area and sufficient organizational storage that minimizes operator fatigue and discomfort while accessing the storage.

SUMMARY OF THE INVENTION

The present invention is a hutch for a desk. The hutch has a top that preferably has a rear edge and at least one side extending forwardly from the rear edge. At least one rotatable support extends downwardly from the top beneath the at least one side that extends forwardly from the rear edge.

In one embodiment, the hutch extends upwardly from a desktop having a first end that extends longitudinally substantially parallel with the rear of the desktop and a second end that extends forwardly from the rear of the desktop at an obtuse angle. A stationary cabinet that has at least one organizer supports the first end and a rotatable cabinet that is substantially rectangular supports the second end. Each of the four faces of the rotatable support has at least one organizer, as described more fully herein below.

These and other aspects of the present invention as disclosed herein will become apparent to those skilled in the art after a reading of the following description of the preferred embodiments when considered with the drawings. The drawings are for the purpose of describing a preferred embodiment of the invention and are not intended to limit the present invention.

DETAILED DESCRIPTION OF THE PREFERRED EMBODIMENT

Figure 1:
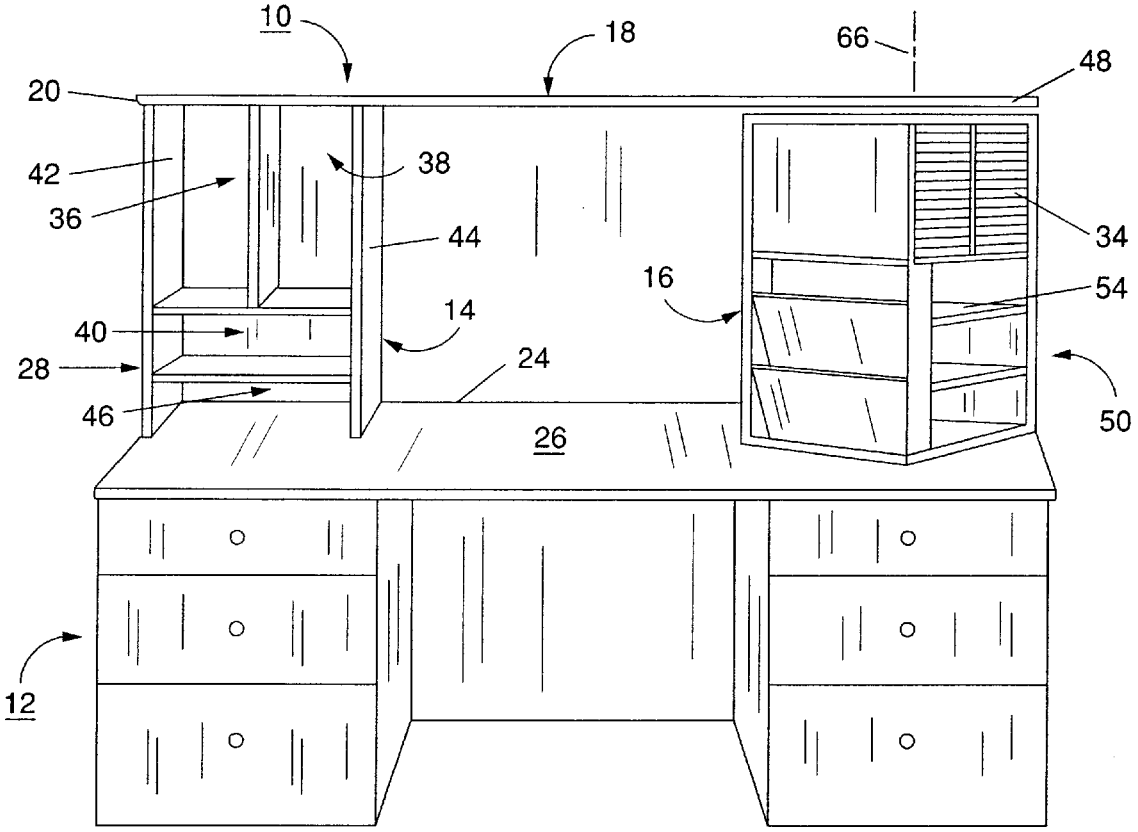
FIG. 1 is a perspective view of an embodiment of the hutch of the present invention on a desk.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

The present invention is a hutch 10 that is adaptable to any conventional desk 12. For illustrative purposes only, the desk 12 is described as shown in FIG. 1 as being substantially rectangular, longer along the rear edge 24 than along the side ends. Hutch 10, however, may be adapted to fit upon a desk 12 of any suitable configuration.

As shown in FIG. 1, the hutch 10 comprises two load bearing supports 14, 16 and a top 18. The supports 14, 16 should be configured to provide sufficient support for top 18 as well as the organizers, as described below. The top 18 preferably extends longitudinally from a first end 20 then bends at an angle 22 forwardly from the rear edge 19 of the top 18 to the second end 48.

The first end 20 of the top 18 may be supported by any appropriate support structure such as a wall panel, column or a rotatable cabinet similar to that described more fully herein as supporting the second end. As shown in FIG. 1, support structure 14 may be a stationary cabinet to support the first end 20. The stationary cabinet may contain any number or type of organizers, as described herein, and an exemplary example is illustrated in FIG. 1 with cubicles formed of shelving 28 for organizing paper or other products.

As shown in FIG. 1, a stationary cabinet may have shelving 28 comprising two vertically extending cubicles 36, 38 and one horizontally extending cubicle 40. A stationary cabinet may be formed with two leg stands 42, 44 that extend upwardly above the desk top 26 such that the shelves 28 of the stationary cabinet form a second horizontally extending cubicle 46 with the upper surface of the desktop 26.

As described above and illustrated particularly in FIG. 2, the second end 48 extends at an angle 22 forwardly away from the rear edge 19 of the top 18. A rotatable storage cabinet 50 preferably supports the second end 48. The rotatable storage cabinet 50 may be any geometrical configuration in cross section, e.g., square, rectangular, polygonal, oval, circular, and the like. As shown in FIGS. 1–4, the cross-section of the rotatable storage cabinet 50 is substantially rectangular in a preferred embodiment. Rotatable storage cabinet 50 has four sides or faces to provide for a plurality of various organizers. As a non-limiting example, as shown in FIGS. 1 and 3–5, each of the four faces may carry a CD rack 34, a corkboard 32, a collapsible copyholder 30, a plurality of slidable trays 54, or shelves 56 or any combination thereof.

Figure 3:
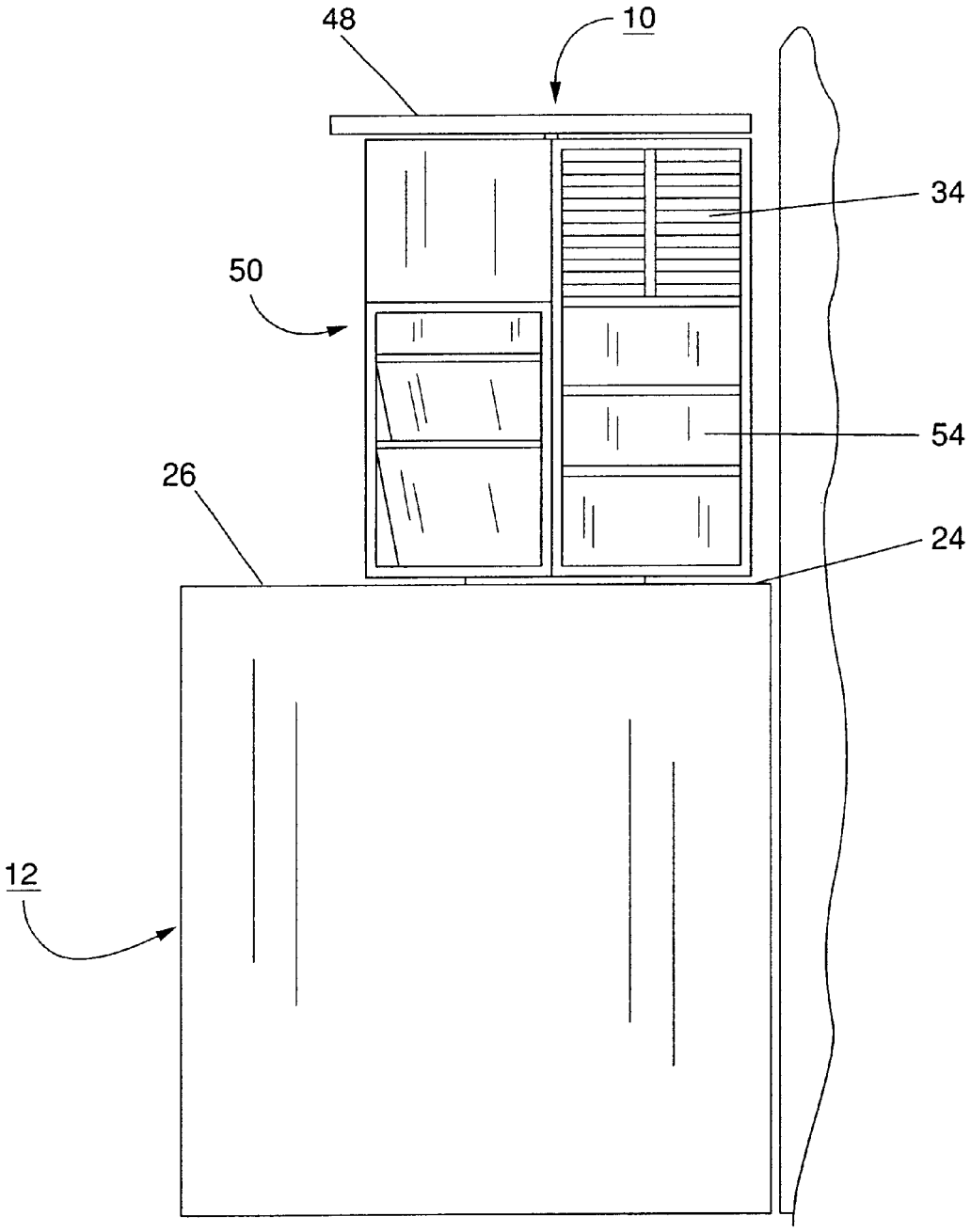
FIG. 3 is a side view of the hutch of the present invention on a desk.

As used herein the terms "organizer" or "organizers" is defined broadly to encompass any number of storage assemblies containing drawers, sections or chambers designed to provide and facilitate orderly and systematic grouping and classification of a variety of items. For example, an organizer could simply be a configuration of horizontal and/or vertical shelving 28 as shown in FIG. 1 designed to facilitate a organization of paper products or work product. One form of organizer may be a collapsible easel 30 (FIG. 4), as are known in the art. As an additional example, an organizer could be a plurality of receptacles, containers, or slidable trays for any of the variety of office products such as paper clips, binder clips, rubber bands, pencils, pens, erasers, paper products, and the like. One form of organizer could be a board 32, as in FIG. 4, that is either a dry-erase or chalkboard for recording and organizing messages, or a corkboard for organizing messages through push pinned notes. Another organizer could be a shelf assembly 34 designed to hold and maintain recordable media, such as DVDs, CDs, diskettes, cassettes, and the like, such as shown in FIGS. 1 and 3. Any of the variety of organizers as known in the art should be considered within the scope of the present invention. Also, any combination of organizers should be considered within the scope of the invention and the present invention should not be limited by the description of the preferred organizer combination.

The rotatable storage cabinet 50 is located forwardly from the rear edge 24 of the desk 12 to facilitate rotation, and ease in the operator's reach and access to the various organizers. The distance that the rotatable storage cabinet 50 extends forward of the rear edge 24 is proportional to angle 22. The forward placement of the rotatable storage cabinet 50 eases fatigue and discomfort when accessing the organizers from a seated position at the desk 12. The preferred angle 22, as illustrated in FIG. 2, is approximately 135° as measured from the rear edge 19 of top 18.

Figure 4:
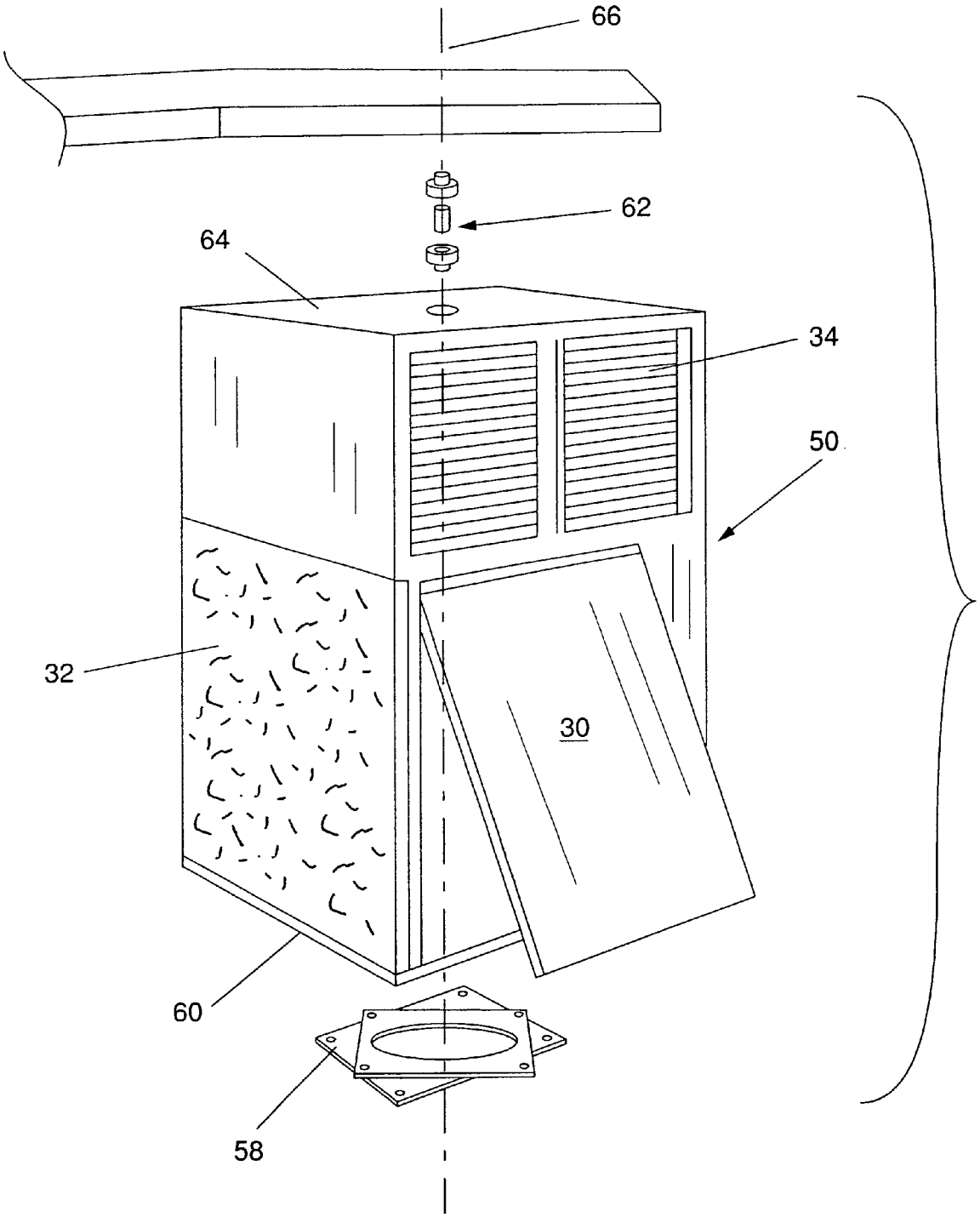
FIG. 4 is an exploded view of one configuration of the rotatable storage cabinet of the hutch of the present invention.
Figure 4A:
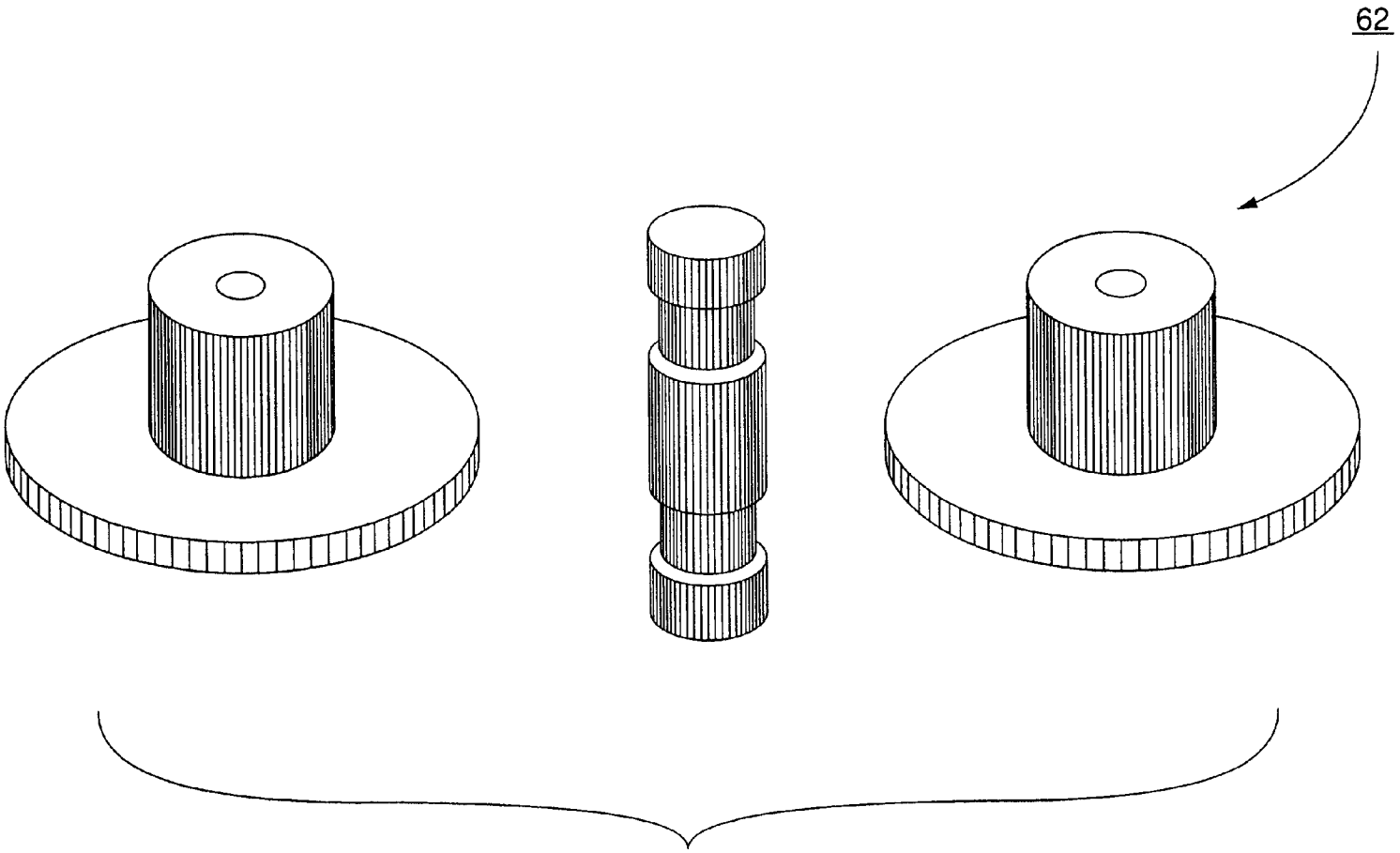
FIG. 4A is a detail view of a rotatable element of the present invention.
Figure 4B:
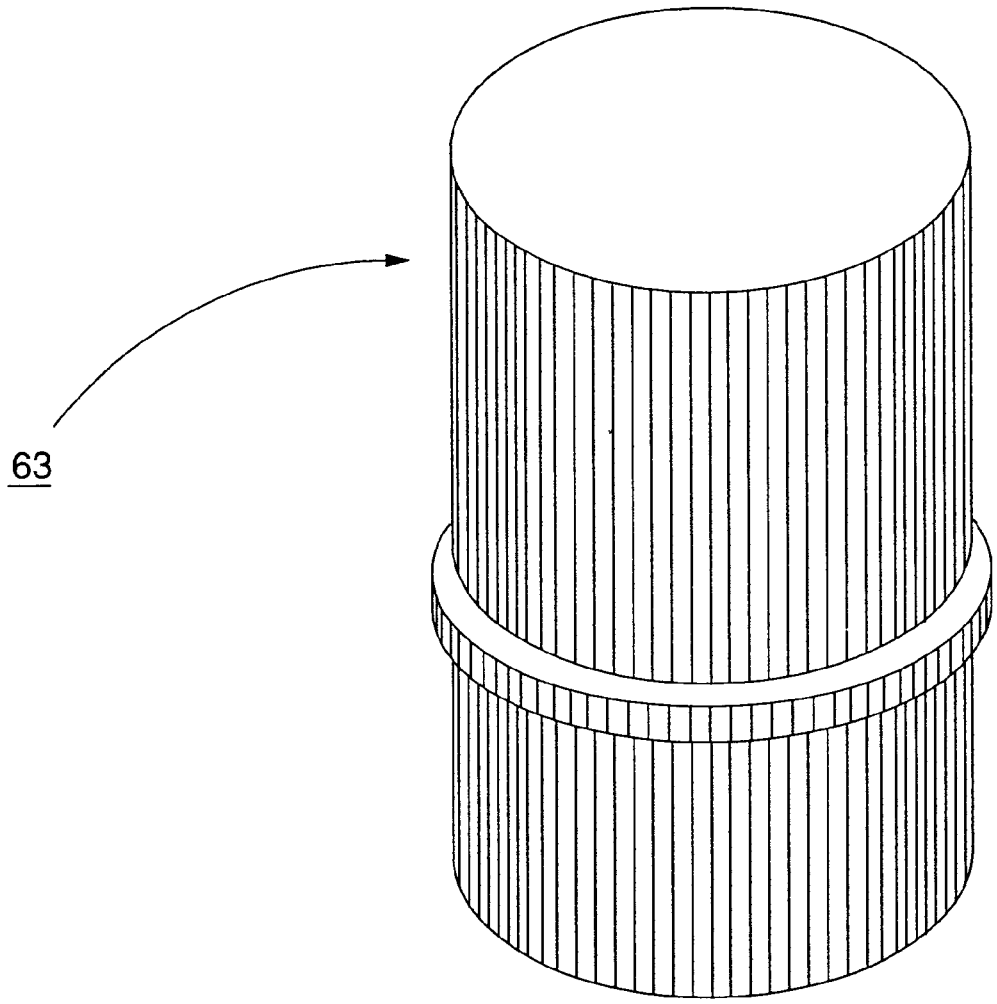
FIG. 4B is a detail view of a rotatable element of the present invention.

FIG. 4 further illustrates a cabinet 50 that is rotatable to optimize storage and convenience. The preferred construction for allowing the cabinet 50 to rotate includes the use of a turntable 58, as are known, attached to the cabinet bottom 60 and swivel hub 62 attached to the cabinet top 64. Thus, the cabinet rotates about an extended axis 66 formed by the swivel hub 62 and turntable 58. Any appropriate construction of rotatable elements, however, should be considered within the scope of the present invention. For example the rotatable element may include but not limited to turntables (ball bearing type or other), swivel hubs 62, similar to that shown in FIG. 4A, or a pivot post 63 as shown in FIG. 4B, or any other appropriate rotatable element.

Figure 2:
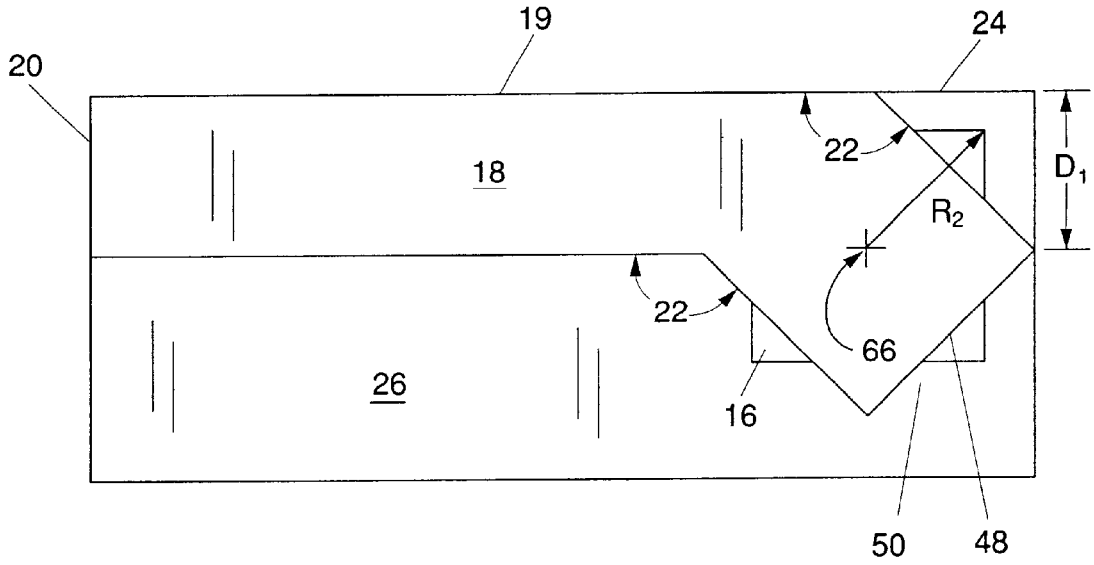
FIG. 2 is a top view of the hutch of the present invention.

The load-bearing rotatable support 16 of FIGS. 1 and 2 has a rotational axis or centerline 66. A radius R1 is defined as the maximum rotational radius created by the furthest extending point of the support. For a support with a rectangular cross-section as shown, the radius R1 is the distance from the axis line 66 to the corner of the rectangular support. The placement of the rotatable support 16 further defines a distance D1 from the centerline 66 to the rear edges 19, 24 of the hutch top and desk, respectively. Preferably, the distance D1 must be greater than R1 to allow for free and complete 360° rotation of the support 16.

The preferred desk and hutch combination includes a desk having a rear edge 24 and a top 26 appropriately configured to allow for a working surface to occupy a substantial portion of the desk top. The hutch 10 should be placed atop the desk top 26, but preferably should not substantially diminish the desk working surface.

As shown in FIGS. 1 and 3–5, a preferred cabinet includes a hinged easel 30, a plurality of slidable trays 54, including a tray that is compartmentalized to hold a variety of office supplies as are known, at least one CD or diskette rack 34 and a corkboard 32. As one of skill in the art will appreciate, the dimensions and variety of organizers can be varied depending upon the end use of the hutch 10. For example, if the user is a computer programmer or the like, the rotatable cabinet may be almost dedicated to recordable media storage with many CD and diskette racks 34. Likewise, if the user is an administrative assistant, the cabinet may include a diverse variety of organizers for facilitating the organization, generation and management of documents. Thus, any of the various organizers known should be considered as within the scope of the present invention.

Figure 5:
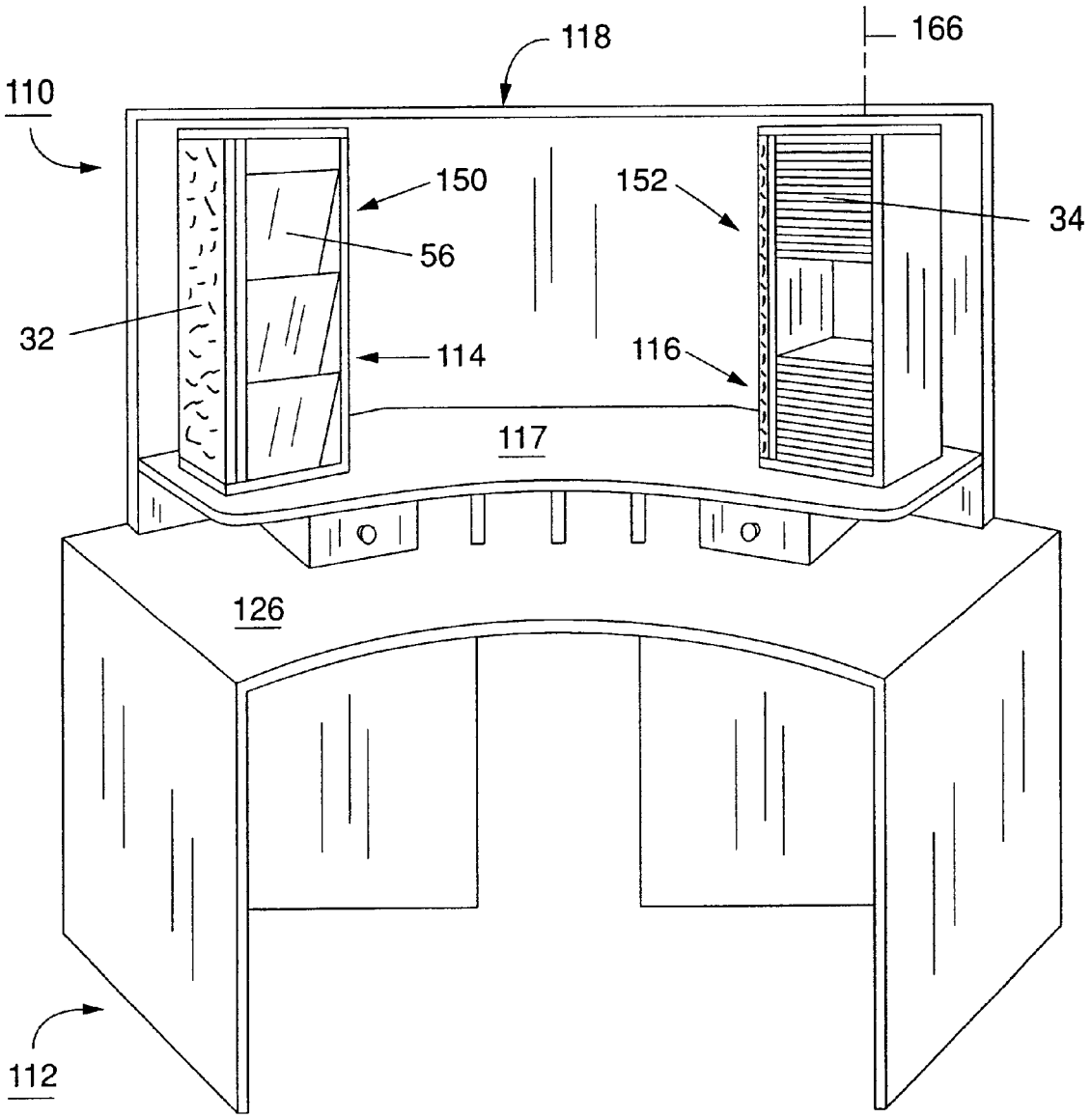
FIG. 5 is a perspective view of an embodiment of the hutch of the present invention on a desk.
Figure 6:
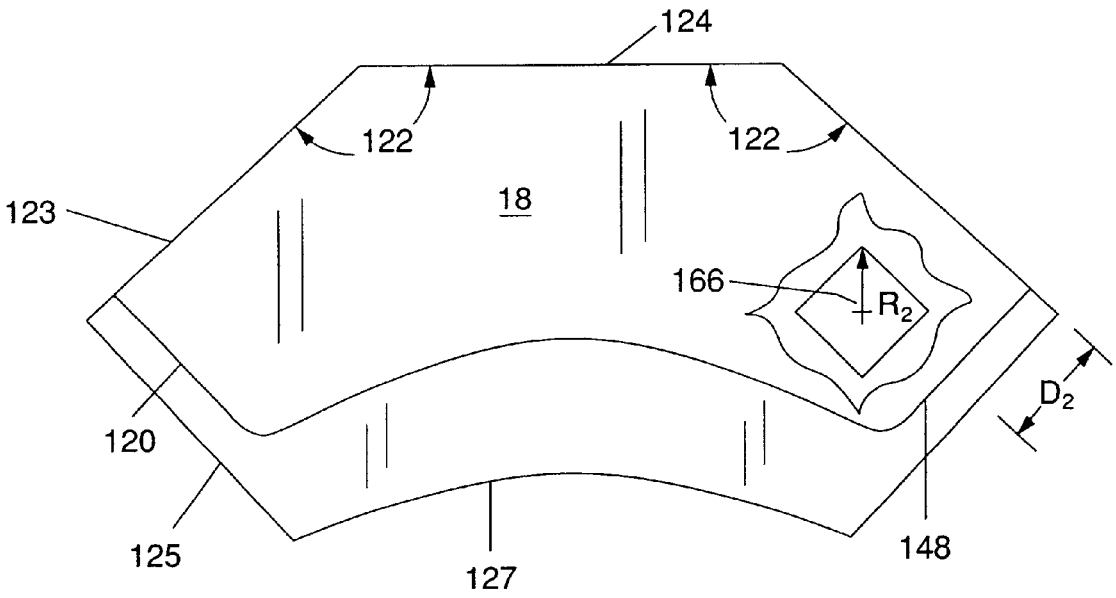
FIG. 6 is a top view of the hutch of the present invention.

As shown in FIGS. 5 and 6, the hutch 110 of the present invention may be configured to fit within a corner area. The desk in FIG. 6 is illustrated as having a rear edge 124, two wall-adjacent ends 123, two outwardly extending ends 125, and a curved front edge 127. Other configurations of a desk adapted for a corner should be considered within the scope of the present invention. For example, there need not be a rear edge 124 and the wall-adjacent ends 123 could extend disposed approximately 90° from each other to substantially fit within a corner. In other words, the hutch 110 may be adapted to fit a desk 112 of any suitable geometrical configuration.

FIG. 5 illustrates a hutch 110, as described herein above, where each support 114, 116 is a rotatable storage cabinet 150, 152. In this embodiment both the first end 120 and second end 148 extend forwardly from the rearward edge 124 of the desk 112 at an angle 122. Preferably the angle 122 on each end 120, 148 is substantially the same, approximately 135° as measured from the rear edge 124. In a preferred corner embodiment, the supports 114, 116 are rotatably sandwiched between top 118 and bottom 117 of the hutch. As shown in FIG. 5, the bottom 117 may have additional organizers such as drawers or cubicles preferably extending beneath the bottom 117 but above the desktop 126.

Thus, the preferred corner configuration has a desk having at least two rear edges, disposed at approximately 90 degrees to another and a desk top 126 having a working surface that occupies a substantial portion of the desk top. The preferred hutch has a top 118 and at least one load-bearing rotatable support 150, 152. As discussed above, the hutch 110 should be placed atop the desk top 126 so as to not substantially diminish the working surface. At least one rotatable support 150, 152 provides at least partial support for the hutch top 118. The support 150, 152 defines a rotation axis 166 and a rotation radius R2. The distance D2 from the axis 166 to the forwardly extending wall-adjacent edge 123 is greater than the rotation radius R2 to allow for free and complete 360° rotation. The forwardly extending edge 123 preferably is disposed at approximately 135° from the rear edge 124. As shown and described above in more detail, the rotatable supports 150, 152 may contain any of a number of organizers. Again, the corner hutch 110 may be configured with a single or multiple rotatable supports, as illustrated.

Although specific embodiments of the present invention have been illustrated and described in detail, it is to be expressly understood that the invention is not limited thereto. The above detailed description of the embodiment is provided for example only and should not be construed as constituting any limitation of the invention. Modifications will be obvious to those skilled in the art, and all modifications that do not depart from the spirit of the invention are intended to be included within the scope of the appended claims.

What is claimed is:

1. A desk having a desk top comprising:

a hutch coupled to and extending upwardly from the desk top;

a first end of the hutch extending longitudinally across the desk top parallel to the rear edge; and a second end extending forwardly at an angle, wherein the angle is approximately 135°; and at least one rotatable support for the hutch positioned at the forwardly extending end such that the rotatable support is positioned upon the desk top forwardly from a rear edge of the desk top.

2. A desk and hutch comprising:

a desk top having a front, a rear and at least two ends, a hutch extending upwardly from the desk top;

wherein two ends of the desktop extend forwardly from the rear of the desktop and the hutch comprises two ends that extend forwardly from the rear of the desktop with each forwardly extending end being supported by a rotatable cabinet having at least one organizer, each of the rotatable cabinets being substantially rectangular thereby having four faces and each of the four faces having at least one organizer.

3. A hutch configured for placement atop a desk, the hutch comprising:

a hutch top having at least one rear edge;

at least one forwardly extending edge disposed at approximately 135° from the rear edge and the distance is measured from the at least one forwardly extending edge; and at least one load-bearing rotatable support providing at least partial support for the top, the support having a rotation radius and an axis, the axis being disposed at a distance from the rear edge, wherein the distance from the axis to the at least one rear edge is greater than the rotation radius.

* * * * *